US005921834A

United States Patent [19]

DeMasi

[11] Patent Number: 5,921,834

[45] Date of Patent: Jul. 13, 1999

[54] BUMPER BALL

[75] Inventor: Douglas D. DeMasi, Hopewell Junction, N.Y.

[73] Assignee: Douglas Builders, Inc., Poughguag, N.Y.

[21] Appl. No.: 08/355,599

[22] Filed: Dec. 14, 1994

[51] Int. Cl.[6] ..... B63B 35/83

[52] U.S. Cl. ..... 441/78; 114/253

[58] Field of Search ..... 440/78, 21, 65; 114/253

[56] References Cited

U.S. PATENT DOCUMENTS

| | | | |
|---|---|---|---|
| 2,938,727 | 5/1960 | Nosak | 441/78 |
| 3,428,015 | 2/1969 | Cloud | 441/78 |
| 3,664,290 | 5/1972 | Finn | 441/78 |
| 3,779,201 | 12/1973 | Spahn | 441/78 |
| 3,806,156 | 4/1974 | Tidwell | 440/21 |
| 4,619,620 | 10/1986 | Felter | 114/253 |

*Primary Examiner*—Stephen Avila
*Attorney, Agent, or Firm*—Joseph B. Taphorn

[57] ABSTRACT

A water toy includes a bumper ball having open ends and inner and outer walls separatable by an air space. Users enter and exit the ball through either or both of the open ends. The ball can be rotated by the occupant moving in one direction in it, as by walking. An open-ended cover, into which the ball is inserted deflated, contains fins on its exterior for interacting with water as the cover rotates when the ball is rotated. The cover also mounts a tow harness for connection to a boat tow rope, and the fins act to restrain spinning as the toy is towed through water.

9 Claims, 3 Drawing Sheets

BUMPER BALL

FIELD OF THE INVENTION

This invention relates to water toys, and more paticularly to a towable inflatable water toy occupied by humans.

BACKGROUND OF THE INVENTION

Water toys are well known. Boats have been used since the dawn of civilization. Tubs including wash tubs, bath tubs whose inlets and outlet were stoppered, and inflated tire inner tubes, have been used to float in water, and moved both by paddling and by towing. Unfortunately, paddling requires extra instrumentalities which complicate the land transportation to and from the water, and are troublesome and dangerous in use. In addtion, many existing water toys sink when ruptured. Furthermore, they tend to have only one use, such as floating or towing but not both.

SUMMARY OF THE INVENTION

Accordingly, an object of the invention is to increase the joy of water sport activity.

Another object of the invention is to provide a water toy that provides a new water-use experience.

An additional object of the invention is to provide a water toy that has multiple uses including operation by an individual himself or several of them and by towing.

Still another object of the invention is to provide a water toy that can be stored in a collapsed condition, yet easily assembled at the water site.

Yet another object of the invention to provide a water toy that is easily transportable and simple and easy to use and also safe.

A further object of the invention is to provide a water toy that is simple and easy of manufacture.

A still further object of the invention is to provide a water toy meeting one or more of the previous objects, that can readily be towed in water and is comfortable to those occupying it.

These and other objects, features and advantages of the invention are achieved by a water toy (of flexible rubber, plastic or the like) that includes an inflatable ball of a size to accommodate one or more upright or standing humans inside. The inflatable ball has an outer wall separated from an inner wall but connected thereto at remote points by partitions. The separated walls serve to define an interior outer space which can be inflated to firm up the ball which had been collapsed for transportation and to keep it afloat when in use. The partitions are such as to divide the interior outer space into a number of compartments which will serve to keep the toy afloat should one of the outer and inner walls be ruptured at a particular place.

The interior wall serves as the floor upon which an occupier of the ball can walk or crawl to rotate the ball. Entrance to the ball would be gained through end openings of which one or both may be somewhat closed off to keep water out while in use, as by snap-in windows, there being sufficient looseness or holes in the snap-in windows to admit the necessary air for breathing.

The outer wall, connected to the inner wall at remote points, snugly mounts a removable form-fitting cover. The cover frictionally engages the outer wall so as to rotate with the ball. The cover has longitudinally extending fins on the outside, so that when a human walks or crawls in one direction inside the ball and the ball rotates in the counter direction, through the reaction of the fins with the water in which it floats, the ball will translate, that is move through the water, in the walking direction.

The longitudinally extending fins on the outside of the ball may stretch across the length of the ball cover. As the ball rotates in water under the action of a human walking inside, successive ones of the fins would engage the water much as the paddle wheel of a steamboat did in times past. The fins are securely fastened to the outside of the cover. They may be equally spaced about the perimeter of the ball.

The toy is also towable. To facilitate towing, one or more tow strips of a towing harness are fixed into the outer surface of the cover and terminate at each end in a circular tow strip. The circular tow strip carrys on its inner periphery several rings to facilitate the attachment of a cross tow bar which would be attached to a tow rope from a power boat. Spinning of the ball during towing will be restricted by the fins.

An advantage of the invention is the safety of the occupant/s should a collision obtain. The inflated space between the inner and outer walls provides a cushion protecting occupant/s from bruises. The ball itself is somewhat protected by the cover.

A feature of the invention is that the occupant/s are also protected from drowning. This because the inflated space between the inner and outer walls is compartmentalized so that upon accidentally ripping open one or several compartments, the other compartments will keep the ball afloat.

Another advantage of the invention is that it is great for going down river rapids, the inflated compartmentalized external space providing safety from bruises and sinking on engagement with rocks. It is also great for ocean adventures such as riding the waves and bouncing off breakers.

BRIEF DESCRIPTION OF THE DRAWINGS OF PREFERRED EMBODIMENTS

These and other objects, features and advantages of the invention will become apparent from a reading of the following description when considered with the appended drawings wherein.

DETAILED DESCRIPTION OF A PREFERRED EMBODIMENT

Figure 1:
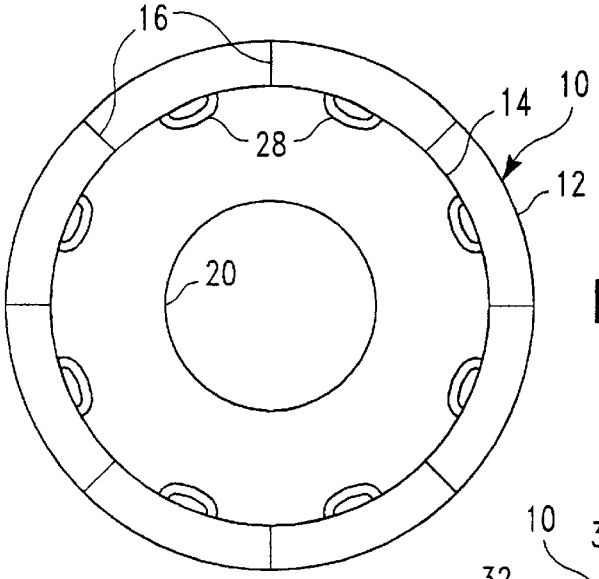
FIG. 1 is a diagrammatic vertical cross-sectional view of a bumper ball according to the invention.

A water toy according to the invention consists essentially of two parts: a bumper ball and a cover therefore. FIG. 1 diagrammatically shows a vertical cross-section through the bumper ball generally indicated by the numeral 10. The bumper ball 10 includes an outer wall 12 spaced from an inner wall 14 by partitions or strips 16 when inflated. The strips 16 divide the space between the outer and inner walls into a number of compartments, such as eight, each of the compartments being provided with conventional inflating and deflating means. The outer and inner walls and strips are made of a tough material such as 30 gauge poly-vinal-cloride (PVC) electronically welded together.

The front and rear ends of the bumper ball are formed with large openings or windows 20 through which users would enter and exit. The strips 16 line the holes between the inner and outer walls.

Figure 5:
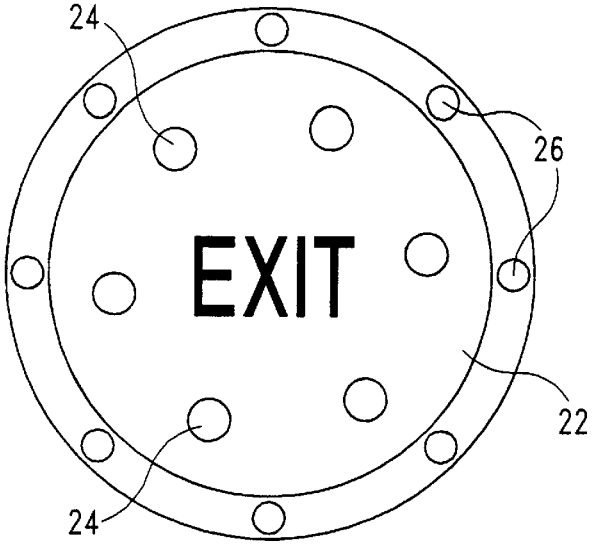
FIG. 5 is a vertical view of a snap-in window for closing off an end opening in the ball.

Snap-on clear circular panes 22 (FIG. 5) may be employed with the outer wall 12 to close off one or both of the openings 20 to the entrance of water. Typically they would be left off when the bumper ball is only being rotated in water; however, during towing the lead opening would be covered. The panes 22 may be loosely fitting to admit breathing air, or they may be formed with breathing holes 24. The snaps 26 would be conventional.

Attached, as by electronic welding, to the inside of the inner wall 14 are handles 28 for sequentially gripping while walking in the ball, or for gripping while in tow. The handles may be made of nylon.

Figure 2:
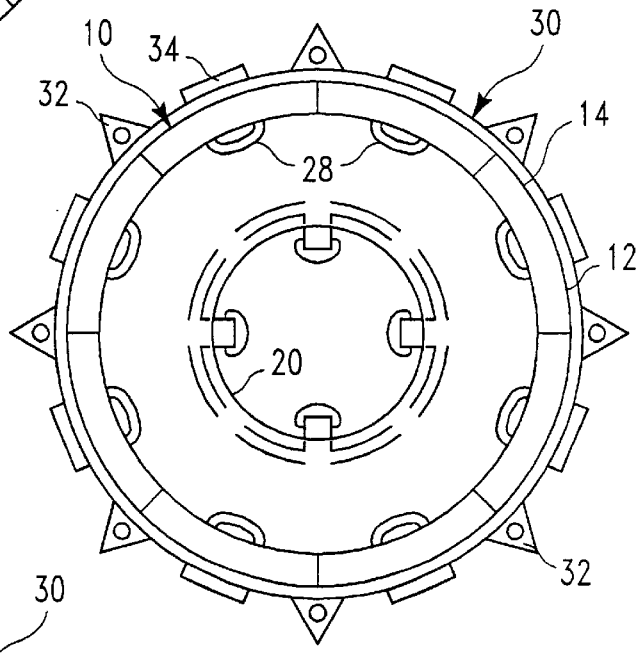
FIG. 2 is the same diagrammatic vertical cross-sectiomal view of the bumper ball, but with the cover having fins and tow straps in place.
Figure 3:
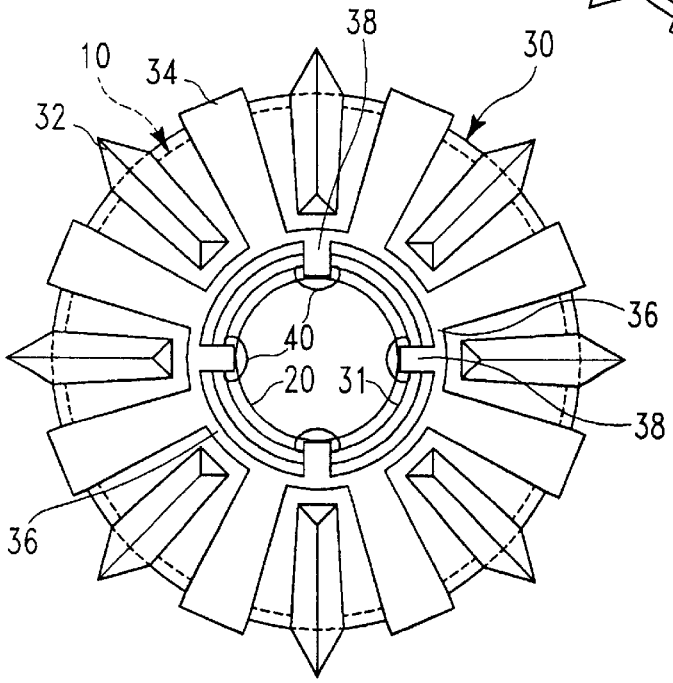
FIG. 3 is a diagrammatic end view of the device of FIG. 2.
Figure 4:
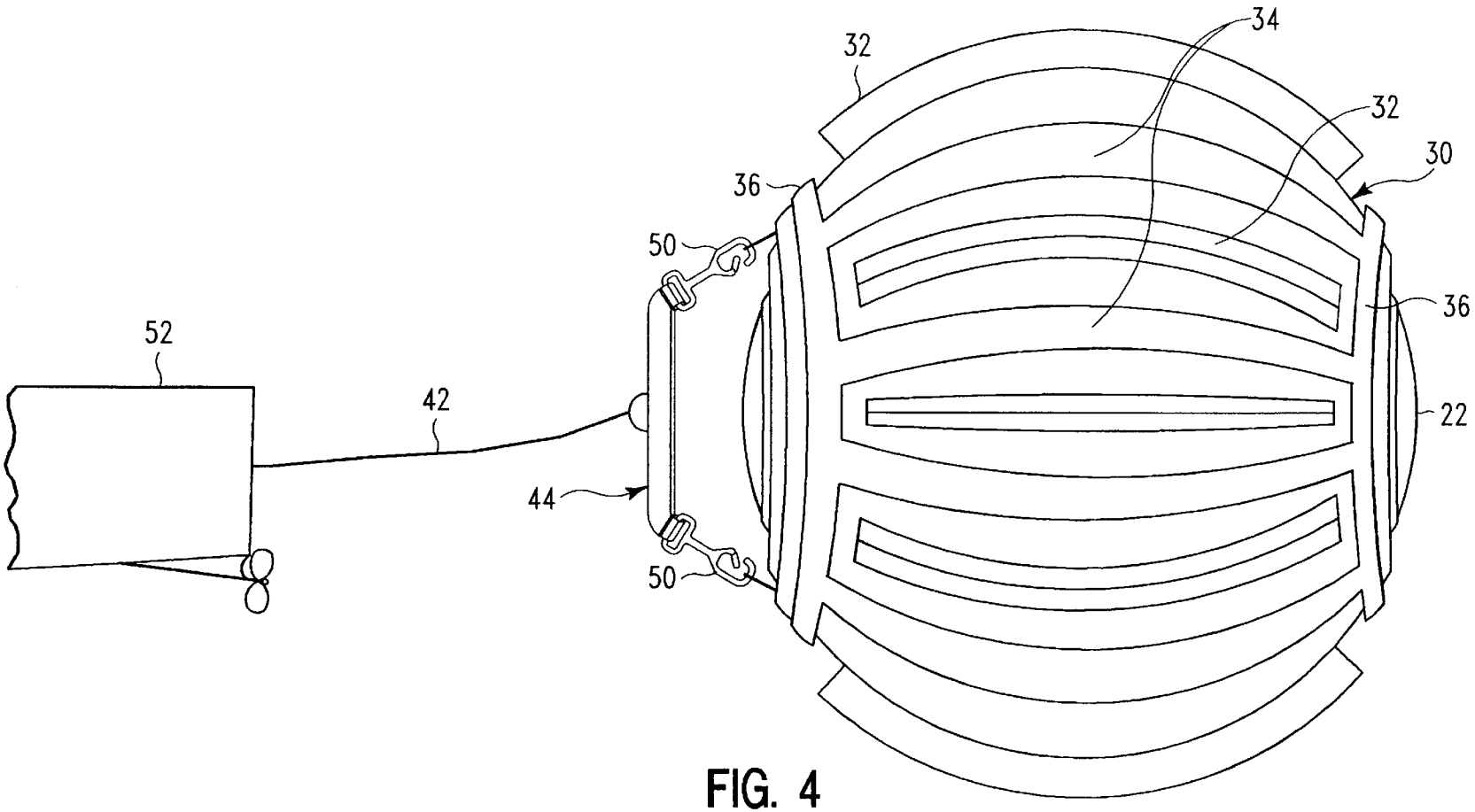
FIG. 4 is a diagrammatic side view of the device of FIG. 2 attached to a boat tow rope.

The cover generally indicated by the numeral 30 (FIGS. 2–4), when a deflated ball 10 is placed inside of it and has its compartments inflated, fits snugly on and frictionally embraces the ball to rotate with it when an occupant walks or crawls within it. It terminates short of the ball openings or windows 20 so as not to impede ball entry or exit therethrough, and thus has larger end openings 31. It may be seamlessly made of 840 denier-coated nylon.

Evenly spaced about the periphery of the cover 30, and extending substantially for its length, are fins 32 fixed thereto. The fins 32 are generally triangular in cross-section and inflatable, as by conventional means at there ends, so that there free corners stick into space. Thus the bottom ones will stick into the water in which the bumper ball 10 is afloat. As the bumper ball rotates, successive ones of the fins 32 engage the water in a paddle-like action to translate the bumper wall through the water. Deflation of the fins on finishing of the water sport facilitates transportation and storage.

Towing of the bumper ball 10 and cover 30 through the water is enabled by a cable harness consisting of nylon straps 34 extending the length of the cover between the fins 32 and terminating at each end of the cover in a nylon circular or ring strap 36. The straps 34 and 36 are electronically welded or sewn to the cover 30. Extending inwardly from the circular strap 36 are four equally-spaced short nylon straps 38 each bearing D-rings 40.

The plurality of straps distribute the towing pressure evenly throughout the entire bumper ball. The large number of D-rings results in very little load being placed on each. Since the front and back of the toy are the same, it can be towed from either end, enabling wear and tear from use to be distributed.

Figure 6:
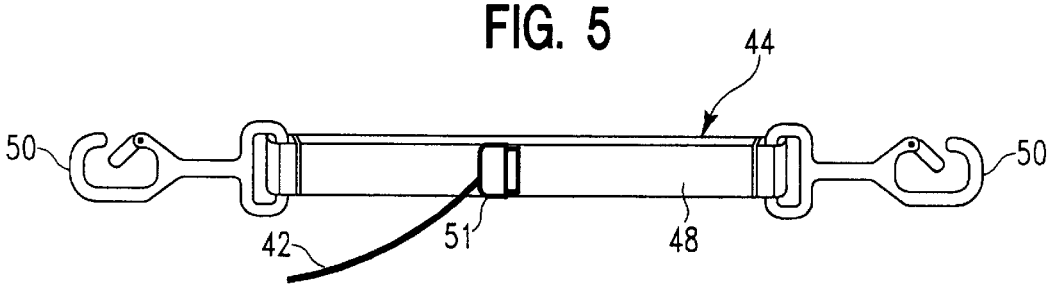
FIG. 6 is a side view of a 2-way cross tow bar for attachment to the tow strips when only one ball occupant obtains.
Figure 7:
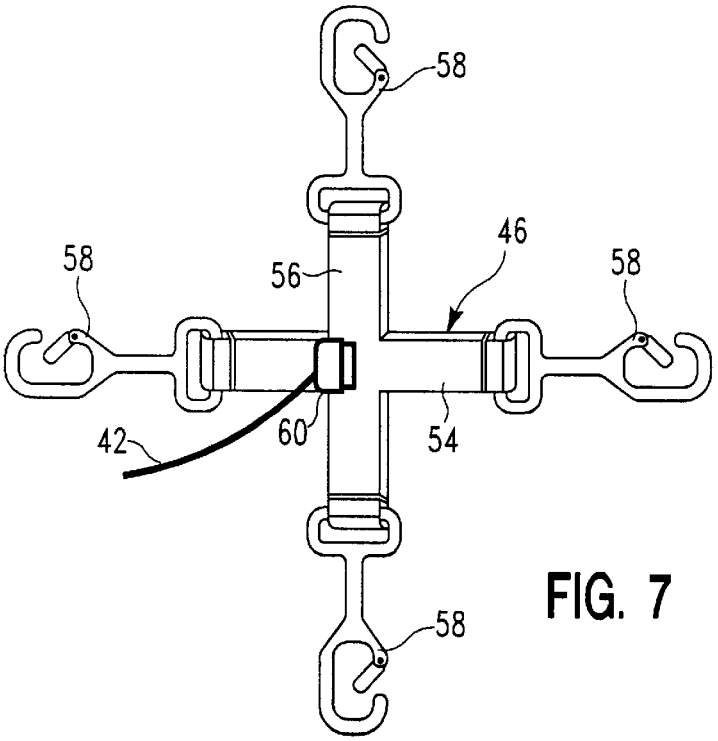
FIG. 7 is a side view of a 4-way cross tow bar for attachment to the tow strips when two or more ball occupants obtain.

Towing of the bumper ball via a single tow rope 42 (FIGS. 4, 6, and 7), may be effected through either a two-way hook generally indicated by the numeral 44 in FIG. 6 or a four-way hook generally indicated by the numeral 46 in FIG. 7. The two-way hook 44, employed when there is only one bumper ball occupant, may be a simple straight nylon strap 48 mounting standard attachment hooks 50 at its outer ends and a boat tow rope ring 51 in the middle. It is of a length to enable ready connection of its hooks 50 to opposite cover cable harness D-rings 40. When the tow rope 42 is attached to a boat 52 (FIG. 4) and the boat moves through the water, the bumper ball will be pulled through the water and generally prevented from spinning by the fins 32.

The four-way hook 46, employed to better distribute stress when there are two or more bumper ball occupants, is a cross nylon strap having a horizontal straight portion 54 and a vertical straight portion 56 mounting standard attachment hooks 58 at their outer ends and a boat tow rope ring 60 in the middle. Like the hooks 50 for the two-way hook 44, the hooks 58 for the four-way hook 46 are connected to opposite cover cable harness D-rings 40.

The water toy of the invention can be used in a number of ways. Thus the bumper ball 10 by itself can be used as just a float. With the cover 30 in place, one or more bumper ball occupants can walk to rotate the ball and cause the fins 32 on the cover to propel the toy through the water. With one or the other of the hooks 44 or 46 in place, the toy can be towed through the water with the fins 32 keeping the toy from spinning freely.

The toy may be transported to and from water site, in a collapsed condition. At the site, if the ball is just to be used as a float, only its compartments are be blown up, and it may be placed in water and entered through one of the windows 20. If it is to be used to travel around in the water by human propulsion, it would have been placed inside the cover 30 before inflation; thereafter, the fins 32 would have been inflated, and thereafter placement in water and occupancy effected. If towing is contemplated, one of the two-way hook 44 or four-way hook 46 is connected to the cable harness D-rings 40 before placement in water; the boat tow rope 42 would be connected to the boat tow ring 51 or 60.

While there have been shown and described preferred embodiments of the invention, it will be apparent to those skilled in the art that other and different applicantions may be made of the principles of the invention. It is therefore intended to be limited only by the spirit and/or scope of the appended claims.

What is claimed is:

1. In a water toy, a bumper ball, entrance/exit end windows in the bumper ball, inflatable compartments about the periphery of the bumper ball, and a cover having longitudinally extending fins on said ball and movable therewith to enable the toy to translate in water when the ball is rotated by an occupant, wherein the bumper ball has an outer wall and an inner wall and the inflatable compartments are there between, and panes for closing off to water but not to air one or both of the end windows.

2. In a water toy, a bumper ball, entrance/exit end windows in the bumper ball, inflatable compartments about the periphery of the bumper ball, and a cover having longitudinally extending fins on said ball and movable therewith to enable the toy to translate in water when the ball is rotated by an occupant, wherein the bumper ball has an outer wall and an inner wall and the inflatable compartments are there between, and handles mounted on the inner wall for engagement by a bumper ball occupant, and panes for closing off to water but not to air one or both of the end windows.

3. In a water toy, a bumper ball, entrance/exit end windows in the bumper ball, inflatable compartments about the periphery of the bumper ball, and a cover having longitudinally extending fins on said ball and movable therewith to enable the toy to translate in water when the ball is rotated by an occupant, wherein the cover has a towing cable harness.

4. A water toy according to claim 3, wherein the bumper ball has an outer wall and an inner wall and the inflatable compartments are there between.

5. A water toy according to claim 4, and handles mounted on the inner wall for engagement by a bumper ball occupant.

6. A water toy according to claim 4, and panes for closing off to water but not to air one or both of the end windows.

7. A water toy according to claim 5, and panes for closing off to water but not to air one or both of the end windows.

8. An article for a bumper ball water toy having end openings, comprising a cover having larger end openings, and longitudinally extending fins on the outside surface for interaction with water when the toy is rotated to restrain its rotation when the toy is towed lengthwise, and a towing harness secured to the cover, wherein the towing harness comprises longitudinally extending straps affixed to the cover.

9. An article according to claim 8, wherein the longitudinally extending straps terminate at at least one of their ends in a circular strap to which a tow hook attachable at a central point to a tow rope from a boat attaches at two or more spaced points for towing.

* * * * *